US007383957B2

(12) United States Patent
Cox

(10) Patent No.: US 7,383,957 B2
(45) Date of Patent: Jun. 10, 2008

(54) SCREENING FINGER TINE ASSEMBLY

(75) Inventor: Matthew Cox, Staffordshire (GB)

(73) Assignee: Extec Screens & Crushers Limited, Swadlincote, Derbyshire (GB)

( * ) Notice: Subject to any disclaimer, the term of this patent is extended or adjusted under 35 U.S.C. 154(b) by 92 days.

(21) Appl. No.: 11/409,258

(22) Filed: Apr. 21, 2006

(65) Prior Publication Data

US 2006/0289686 A1 Dec. 28, 2006

(30) Foreign Application Priority Data

Apr. 22, 2005 (GB) ..... 0508098.1
Aug. 17, 2005 (GB) ..... 0516838.0

(51) Int. Cl.
*B07B 1/46* (2006.01)

(52) U.S. Cl. ..... 209/395

(58) Field of Classification Search ..... 209/314, 209/395

See application file for complete search history.

(56) References Cited

U.S. PATENT DOCUMENTS 4,361,240 A * 11/1982 Davis et al. ..... 209/674
5,108,589 A 4/1992 Sherman
5,322,170 A * 6/1994 Hadden ..... 209/314
5,769,240 A 6/1998 Middour et al.
6,116,428 A * 9/2000 Loshe ..... 209/319

FOREIGN PATENT DOCUMENTS

EP 0631825 5/1994
GB 2247850 3/1992

* cited by examiner

*Primary Examiner*—Joseph C Rodriguez
(74) *Attorney, Agent, or Firm*—Kirton & McConkie; Evan R. Witt

(57) ABSTRACT

A screening finger assembly having a holder (19) and a set of generally parallel finger tines (16) spaced apart in a row and each mounted in cantilever manner in a respective mounting (20, 22) in the holder (19). Each tine (16) has an outboard end (17), and an inboard end (18) which is firmly clamped in the respective mounting (20, 22). The inboard end (18) of each tine (16) includes a tapered portion. Each mounting includes a mounting bush (20) which is securely mounted in position in the holder (19), and an intermediate load-absorbing sleeve (22) arranged internally of the bush (20) and having an internal surface corresponding in shape to the tapered portion (18) of the tine (16) which it receives. A fastening means (23, 24) moves the tapered portion (18) of the tine (16) axially into firm clamping engagement with the internal surface of the intermediate sleeve (22) to clamp the tine (16) in position.

10 Claims, 2 Drawing Sheets

SCREENING FINGER TINE ASSEMBLY

BACKGROUND OF THE INVENTION

This invention relates to a screening finger tine assembly which comprises a holder, and a set of finger tines laterally spaced apart from each other in a row and each mounted in cantilever manner in a respective mounting in the holder.

Finger tine assemblies of this type may be mounted in a screen box, and typically each assembly has a bank of fingers arranged in a cassette, and the cassettes are arranged successively from an upper bulk material receiving end of the box to a lower discharge end of the box from which oversized material can be discharged. The banks of fingers in the cassettes can be arranged with varying spacing apart between the fingers from one cassette to another, to allow different sizes of screened material to pass downwardly between the fingers into the screen box, for collection and subsequent discharge to respective stockpiles corresponding to each required graded size range of screened material.

The screen box will usually have a vibrating mechanism coupled with it to apply vibration to the cassettes so that the fingers will vibrate and thereby promote the screening action and possibly assist in breaking down the bulk material into smaller fragments.

It is present practice to mount the inboard end of each finger tine in a steel bush which is welded or otherwise secured to a common hollow transverse carrier or mounting beam provided for the finger tines of each set (cassette).

The inboard end of the tine is usually tapered, in the sense that it reduces in diameter in a direction from the outboard end to the inboard end, and therefore the steel bush (which acts as a holder to provide cantilever mounting of the finger tine) has a matching internal tapered shape also, so that firm holding contact can be maintained with the entire outer surface of the tapered end of the finger tine.

The inboard end of the tine is usually clamped firmly within the bush by applying an axial force to the tine so as to press the tapered end of the tine firmly into engagement with the internal surface of the bush. This is achieved by tightening a clamping nut which reacts against an end face of the bush to apply necessary tensile force to the tine.

The cantilever mounting of each finger tine is therefore a very rigid assembly, and which must be robustly constructed in order to withstand the impact loadings to which the tines are subjected to. In this respect, it should be bourne in mind that bulk material to be screened e.g. site rubble, soil, stones etc. is usually dumped onto the receiving end of the screen box via an excavator bucket or dumper truck, and such material falls under gravity onto the fingers. Also, the fingers are caused to vibrate, in order to screen the material, and therefore substantial bending and shear loads are applied to the fingers, all of which have to be bourne by the mounting of the bushes in the hollow transverse carrier beam.

Therefore, during usage over a period of time, the shock and vibration loadings tend to cause cracks to be generated in the beam, and the bushes then are no longer held rigidly in position, and/or the tines also may snap at positions along their length. A failure of even a single one of the finger tines of a set or cassette has an adverse effect on the overall screening efficiency of the cassette, and necessary repairs of even a single tine represent substantial downtime in the operation of the screen box, which reduces overall operating efficiency.

The present invention has therefore been developed primarily with a view to address this problem and to provide, in simple manner, a cantilever mounting assembly for each finger tine which is better able to withstand shock and vibration loadings to which the tine is exposed during normal usage.

SUMMARY OF INVENTION

According to the invention there is provided a screening finger assembly which comprises a holder, and a set of generally parallel finger tines spaced apart in a row and each mounted in cantilever manner in a respective mounting in the holder, in which:

each tine has an outboard end, and an inboard end which is firmly clamped in the respective mounting;

the inboard end of each tine includes a tapered portion;

each mounting takes the form of a mounting bush which is securely mounted in position in the holder, and an intermediate load-absorbing sleeve arranged internally of the bush and having an internal surface corresponding in shape to the tapered portion of the tine which it receives; and fastening means which is operative to move the tapered portion of the tine axially into firm clamping engagement with the internal surface of the intermediate sleeve to clamp the tine in position.

The intermediate sleeve is therefore able to absorb at least some of the vibrational and shock loadings which may be applied to the respective finger tine during normal use, and thereby reduce the possible adverse effect which such loadings might otherwise have, if applied direct to the mounting bush, as presently can happen with known cantilever mounting assemblies.

The intermediate sleeve can be made of any suitable load absorbing material, including elastomeric material, such as natural or synthetic rubber; or may be made of rigid or semi-rigid plastics material.

Usually, although not essentially, the tapered portion of each finger tine will reduce in diameter in a direction towards the inboard end, and which will facilitate assembly of the tine with the sleeve by a simple push-fit sliding operation. The fastening means may take the form of a nut which can be tightened onto a rearwardly projecting threaded portion of the tine.

Conveniently, the bush has an end flange which is engageable by the nut as the assembly is tightened into firm clamping position in the holder.

The holder may comprise a hollow transversely extending beam in which a row of bushes is fixedly mounted.

Preferably, each finger tine assembly forms a set or cassette, and a succession of such sets are arranged on the upper deck of a screen box, each having spacing apart of the respective finger tines to suit the grading performance required of the set.

As an alternative to a tapered portion of each tine reducing in diameter towards the inboard end, the tapered portion may increase in diameter, in which case the sleeve will have a matching internal shape, and the assembly may then be completed by sliding movement of the sleeve over the tine in a direction from the outboard end to the inboard end, until it comes into engagement with the respective bush. The fastening means may then comprise an adjusting screw engageable with the inboard end of the tine to move the tine axially outwardly so that firm clamping engagement takes place between the tapered portion and the sleeve.

The tapered portion may have other cross-sectional shapes than circular, and may include square, or other flat-sided sections.

A preferred embodiment of screening finger tine assembly according to the invention will now be described in detail, by way of example only, with reference to the accompanying drawings.

DESCRIPTION OF PREFERRED EMBODIMENTS

Figure 1:
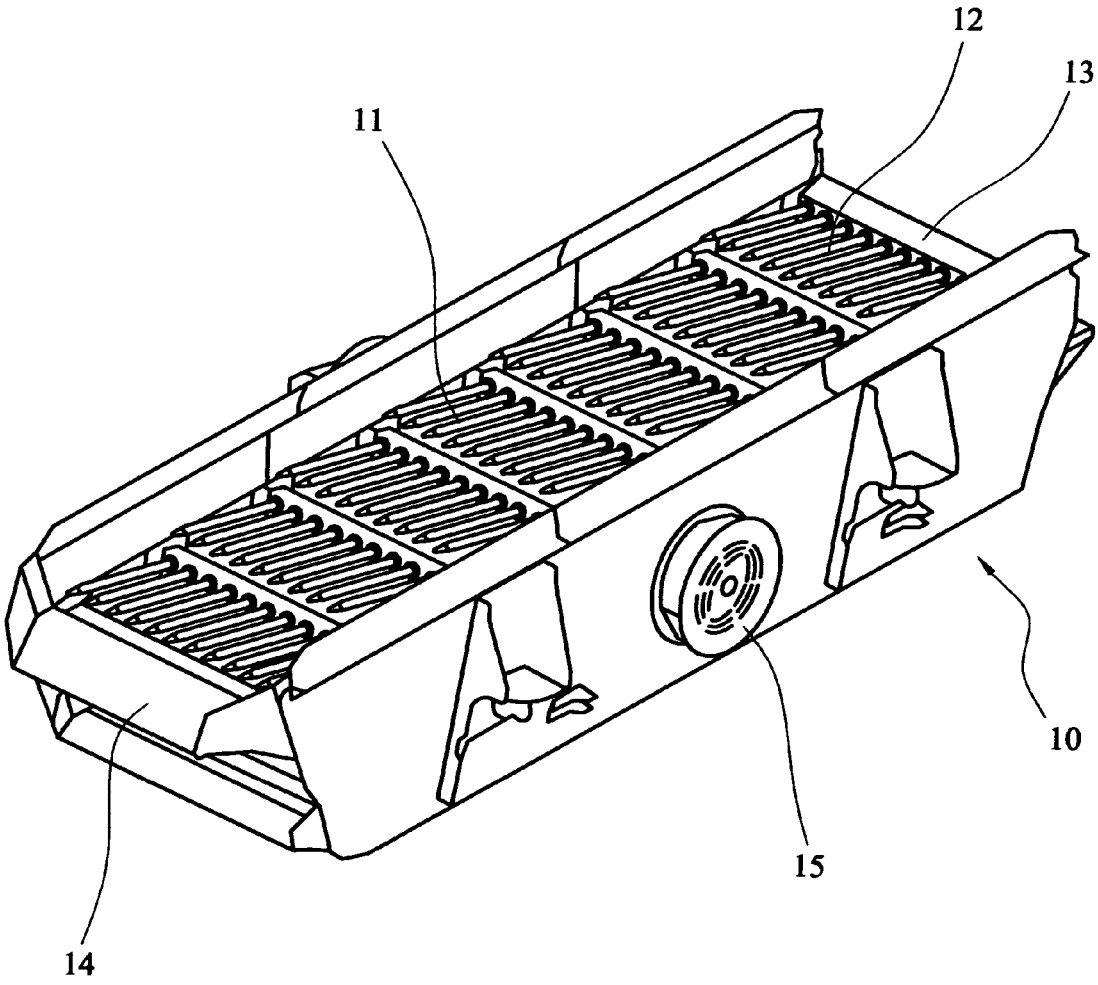
FIG. 1 is a perspective illustration of a typical screen box having an upper deck in which a succession of sets or cassettes of finger tine assemblies according to the invention may be mounted.

Referring first to FIG. 1 of the drawings, a typical screen box is shown, designated generally by reference 10, and having an upper deck 11 provided by a succession of separate sets or cassettes of finger tine assemblies 12. The screen box 10 has an upper receiving end 13 at which a supply of bulk raw material can be dumped, and a lower discharge end 14 from which oversized material can be discharged. The spacing apart of the finger tines in each cassette can be varied from one to the other, according to the required graded size of material, and such material will pass downwardly between the fingers to be received in a collecting space within the screen box 10, and then be discharged by conveyors or the like to suitable stockpiles of different graded sizes of material.

Usually, the screen box 10 will be provided with a vibrating mechanism, such as a rotating eccentric mass 15, which applies vibration energy to the frame of the screen box, and which is transmitted to each of the finger tine assemblies 12. The vibration energy applied to the fingers assists in the screening action, and may also help in breaking down the bulk material into smaller fragments.

Figure 2:
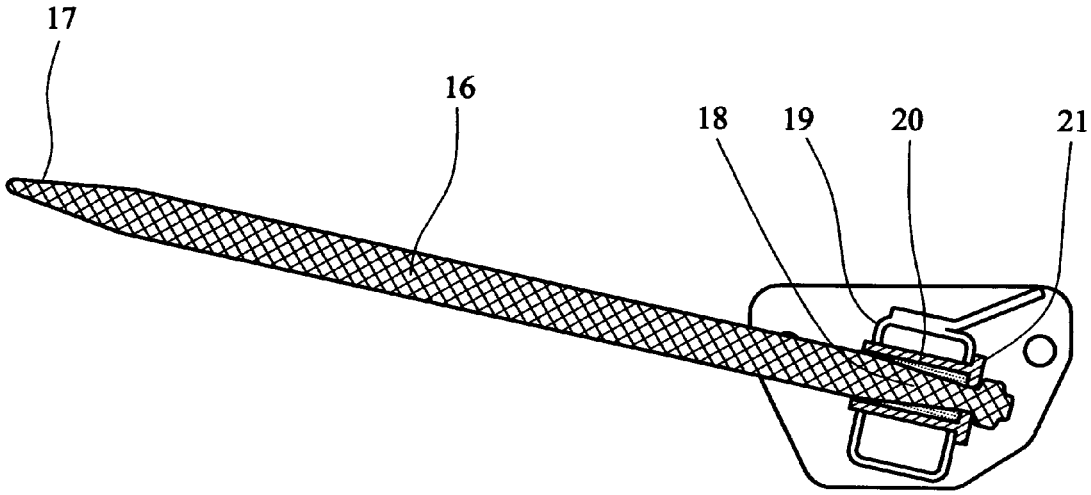
FIG. 2 is a longitudinal sectional view of a preferred embodiment of cantilever mounting of a finger tine in an assembly according to the invention.
Figure 3:
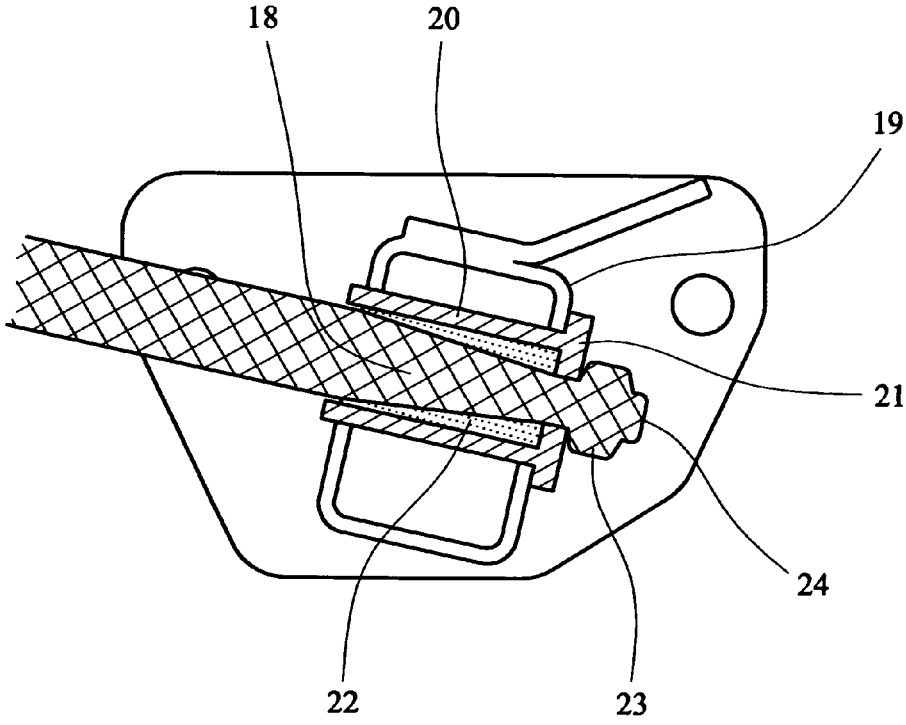
FIG. 3 is a detail view, to an enlarged scale, of the cantilever mounting assembly of the finger tine shown in FIG. 2.

Referring now to FIGS. 2 and 3, there will be described preferred novel mounting assembly of each finger tine, such tines been mounted in cantilever manner at their inboard ends on a common transversely extending mounting beam.

A typical finger tine is shown, designated by reference 16, having a point 17 at its outboard end, and a tapered portion 18 at its inboard end. The inboard end is mounted in cantilever manner in a common transverse hollow metal beam 19, via a novel mounting assembly which will be described below.

The mounting assembly for the inboard end of each tine takes the form of a rigid mounting bush 20 which is securely mounted in position in the holder beam 19, and takes the form of a steel bush having a cylindrical portion which is firmly clamped in position in suitable mounting holes formed in the front and rear walls of the beam 19 e.g. by welding, and also having an end flange 21 which engages with the rear face of the transverse beam 19.

However, if detachable mounting of each bush 20 is required, they may be mounted in position by suitable force fit, and be firmly clamped in position when the tine itself also is mounted within the bush, in a manner discussed in more detail below.

In addition to the mounting bush 20, the mounting assembly also includes an intermediate load-absorbing sleeve 22 which is arranged internally of the bush 20 and which has an internal surface corresponding in shape to the tapered portion 18 of the tine 16 which it receives.

Fastening means is provided and which is operative to move the tapered portion 18 axially in an inboard direction i.e. to the right in FIGS. 2 and 3, so as to bring the tapered portion 18 and the internal surface of sleeve 22 into firm clamping engagement, thereby to clamp the tine 16 in position.

In the illustrated embodiment, the fastening means takes the form of a nut 23 which can be tightened on a rearwardly projecting threaded portion 24 of the tine 16, and nut 23 comes into engagement with the end flange 21 and reacts therefrom in order to tighten the assembly.

The intermediate sleeve 22 is able to absorb some of the vibrational and shock loadings which may be applied to the respective finger tines 16 during normal use, and thereby reduce the possible adverse effect which such loadings might otherwise have, if applied direct to the mounting bush 20.

The intermediate sleeve 22 is made of any suitable load absorbing material, including elastomeric material, such as natural or synthetic rubber. Alternatively, suitable rigid or semi-rigid plastics material may be used.

The tapered portion 18 of each tine 16 reduces in diameter, in a direction towards the inboard end, as shown in the preferred embodiment. This facilitates assembly of the tine 16 with the sleeve 22, by a simple push-fit sliding operation.

However, it is within the scope of this invention to provide a different arrangement of the mounting assembly of the inboard end of the tine 16. The tapered portion may increase in diameter in a direction towards the inboard end, in which case the internal surface of the sleeve 22 will have a matching shape. Then, to complete the assembly, it will be necessary to slide the sleeve 22 in a direction axially of the tine 16, from the outboard end 17, until it comes into engagement with the internal surface of the bush 20. Alternative fastening means may then comprise an adjusting screw engageable with the inboard end of the tine to move the tine axially outwardly so that firm clamping engagement takes place between the tapered portion and the sleeve.

FIGS. 2 and 3 illustrate a preferred cantilever mounting of an individual finger tine 16 of a set or cassette, and a plurality of such sets may be arranged in succession, on the upper deck of a screen box 10, as shown in FIG. 1.

Although the invention has been described, by way of example only, with reference to a screening finger assembly with reference to the accompany drawings, it should be understood that the invention has wider applications. The features of the screening finger assembly as claimed can equally be employed in other types of apparatus utilising sets of parallel tines e.g. a front loader on an agricultural tractor, or forwardly extending tines provided on the leading edge of an excavator bucket.

The invention claimed is:

1. A screening finger assembly which comprises a holder, and a set of generally parallel finger tines spaced apart in a row and each mounted in cantilever manner in a respective mounting in the holder, in which:

each tine has an outboard end, and an inboard end which is firmly clamped in the respective mounting;

the inboard end of each tine includes a tapered portion;

each mounting takes the form of a mounting bush having an internal surface extending a distance along the length of the tine, the bush securely mounted in position in the holder, and an intermediate load-absorbing sleeve arranged internally of the bush and having an internal surface corresponding in shape to the tapered portion of the tine which it receives and an external surface for positioning against said internal surface of the bush; and fastening means which is operative to move the tapered portion of the tine axially into firm clamping engagement with the internal surface of the intermediate sleeve and the internal surface of the bush into firm clamping engagement with the external surface of the intermediate sleeve to clamp the tine in position.

2. A finger assembly according to claim 1, in which the intermediate load bearing sleeve is made of elastomeric material.

3. A finger assembly according to claim 2, in which the sleeve is made of natural or synthetic rubber.

4. A finger assembly according to claim 1, in which the sleeve is made of rigid or semi-rigid plastics material.

5. A finger assembly according to claim 1, in which the tapered portion of each finger tine reduces in diameter in a direction towards the inboard end, and the fastening means takes the form of a nut which can be tightened onto a rearwardly projecting threaded portion of the tine.

6. A finger assembly according to claim 5, in which the bush has an end flange which is engageable by the nut as the assembly is tightened into firm clamping position in the holder.

7. A finger assembly according to claim 1, in which the holder comprises a hollow transversely extending beam in which a row of bushes is fixedly mounted.

8. A screen box having an upper deck formed by a succession of finger tine assemblies according to claim 1.

9. Apparatus having at least one set of parallel tines and which comprises a holder, and a set of generally parallel tines spaced apart in a row and each mounted in cantilever manner in a respective mounting in the holder, in which:

each tine has an outboard end, and an inboard end which is firmly clamped in the respective mounting;

the inboard end of each tine includes a tapered portion;

each mounting takes the form of a mounting bush having an internal surface extending a distance along the length of the tine, the bush securely mounted in position in the holder, and an intermediate load-absorbing sleeve arranged internally of the bush and having an internal surface corresponding in shape to the tapered portion of the tine which it receives and an external surface for positioning against said internal surface of the bush; and fastening means which is operative to move the tapered portion of the tine axially into firm clamping engagement with the internal surface of the intermediate sleeve and the internal surface of the bush into firm clamping engagement with the external surface of the intermediate sleeve to clamp the tine in position.

10. Apparatus according to claim 9, and taking the form of a front loader on an agricultural tractor, or forwardly extending tines provided on the leading edge of an excavator bucket.

* * * * *